United States Patent [19]

Mizuguchi

[11] Patent Number: 4,481,979

[45] Date of Patent: Nov. 13, 1984

[54] HEALD FRAME DRIVING METHOD IN NEGATIVE DOBBY MACHINES OR CAM MACHINES

[75] Inventor: Hiroyuki Mizuguchi, Aichi, Japan

[73] Assignee: Yamada Dobby Co., Ltd., Bisai, Japan

[21] Appl. No.: 418,788

[22] Filed: Sep. 16, 1982

[51] Int. Cl.[3] ..... D03C 13/00

[52] U.S. Cl. ..... 139/84; 139/82; 139/88

[58] Field of Search ..... 139/84, 82, 88, 66 R, 139/83, 55.1

[56] References Cited

U.S. PATENT DOCUMENTS

| | | | |
|---|---|---|---|
| 3,967,653 | 7/1976 | Lyman, Jr. | 139/88 |
| 4,222,415 | 9/1980 | Palau | 139/83 |

FOREIGN PATENT DOCUMENTS

| | | | |
|---|---|---|---|
| 66655 | 12/1982 | European Pat. Off. | 139/82 |
| 2111248 | 8/1972 | Fed. Rep. of Germany | 139/66 |
| 2477186 | 9/1981 | France | 139/82 |
| 51-17333 | 5/1976 | Japan . | |

*Primary Examiner*—James Kee Chi

*Attorney, Agent, or Firm*—Armstrong, Nikaido, Marmelstein & Kubovcik

[57] ABSTRACT

This invention relates to a heald frame driving means having resilient transmission members connected to a shedding lever of a negative dobby machine or cam machine disposed above the heald frame and engaged with the heald frame through working levers and connecting rods to move the heald frame downward, and tension coil spring means to apply upward restoring force, thereby reducing tension in and abrasion of the resilient transmission members.

2 Claims, 1 Drawing Figure

HEALD FRAME DRIVING METHOD IN NEGATIVE DOBBY MACHINES OR CAM MACHINES

BACKGROUND OF THE INVENTION

This invention relates to a driving method for moving a healed frame up and down in negative dobby machines or negative cam machines installed to looms.

In the prior art, when a resilient transmission member such as a rope connected to a shedding lever of a negative dobby machine or cam machine is disposed above a heald frame, the heald frame driving method is performed by raising the heald frame using tension of the rope and depressing it using spring restoring force. In this driving method, however, for example, when spun yarn fabric is woven in refined clothing fashion, if the tension of the downward warp is made larger than that of the upward warp, spring tension must be increased. Since the heald frame is raised against the above mentioned spring tension, a large force acts on the rope and on the negative dobby machine body or the negative cam machine body, thereby abrasion is increased in such part and power is lost. Moreover, since the spring and related members are disposed below the heald frame, maintenance is inconvenient and operability is not favorable.

SUMMARY OF THE INVENTION

This invention involves a heald frame driving method when a resilient transmission member such as a rope connected to a shedding lever of a negative dobby machine or cam machine is disposed above a heald frame, wherein the resilient transmission member is engaged with the heald frame through a working lever, a connecting rod or the like, and driving is effected so that the heald frame is moved downwards by tension of the resilient transmission member and upwards by restoring force of a spring, and the operating lever, connecting rod, spring and the like are arranged at the side or top of the heald frame.

An object of this invention is to provide a heald frame driving method apparatus wherein spring tension acting on a heald frame is small when tension of the downward warp is less than that of the upward warp, and abrasion is small on the resilient transmission member at the working member such as the negative dobby machine body or cam machine body.

Another object of this invention is to provide a heald frame driving method, wherein the working lever, connecting rod and spring to engage the resilient transmission member with the heald frame are arranged at the side or top of the heald frame, and maintenance and adjustment are easy.

Still another object of this invention is to provide a heald frame driving method wherein power loss is small.

The above mentioned and other objects and features of this invention will be apparent from the following description referring to the accompanying drawing.

DESCRIPTION OF THE PREFERRED EMBODIMENT

Figure 1:
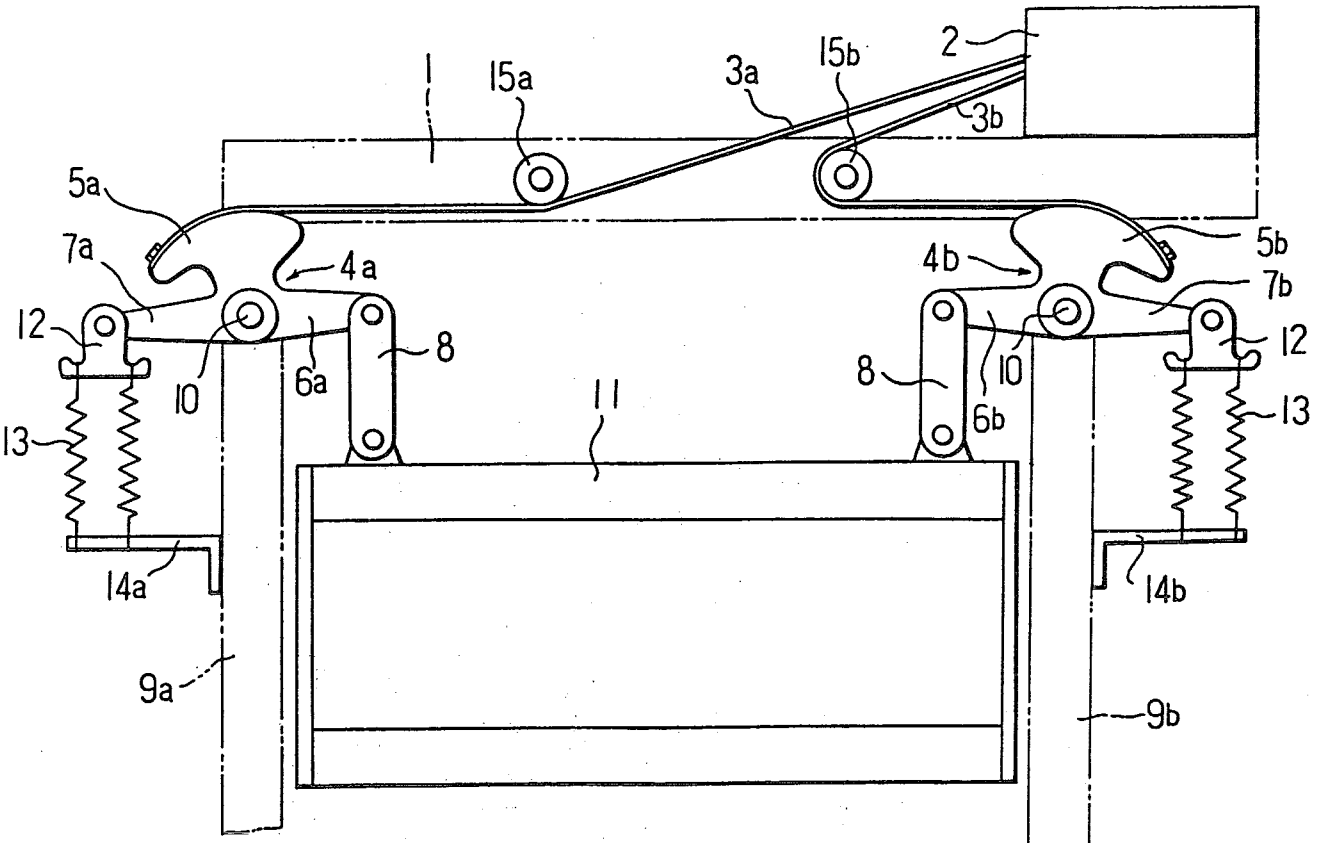
FIG. 1 is a schematic front view of an embodiment of this invention.

FIG. 1 shows an embodiment of this invention. In the figure, a negative dobby machine body 2 is mounted on the right end of the upper surface of a top beam 1 of a loom, and a plurality of heald frames 11, which correspond to a plurality of shedding levers (not shown) of the negative dobby machine body 2 and have the same number as that of the shedding levers, are arranged in the longitudinal direction. One shedding lever is connected to two ropes 3*a*, 3*b* for one heald frame 11 corresponding thereto. The top beam 1 of the loom is provided with pins projecting at positions left and right of the center of the beam, and a plurality of guide pulleys 15*a*, 15*b* corresponding to the heald frames 11 are rotatably supported by respective pins. Shafts 10 project respectively on both side frames 9*a*, 9*b* of the loom at the sides of the heald frames 11, and a plurality of working levers 4*a* and 4*b* are pivotally supported respectively by the shafts 10 corresponding to each heald frame 11. The working levers 4*a* and 4*b* are formed in lateral symmetry and are provided with sector portions 5*a*, 5*b* on the upper side, connecting portions 6*a*, 6*b* on the inner side, and arms 7*a*, 7*b* on the outer side. The rope 3*a* guided by the guide pulley 15*a* is connected to the sector portion 5*a*; the rope 3*b* guided by the guide pulley 15*b* is connected to the sector portion 5*b*. Connecting rods 8, 8 are joined with pins respectively to the connecting portions 6*a*, 6*b*, and each of the connecting rods 8, 8 stands upright and the bottom end thereof is pivotally connected to the heald frame 11. Hooks 12, 12 are joined with pins respectively to outer ends of the arms 7*a*, 7*b*, and brackets 14*a*, 14*b* are installed below the arms 7*a*, 7*b* in opposing relation thereto. The brackets 14*a*, 14*b* are attached to the side frames 9*a*, 9*b*, and two tension coil springs 13 are stretched between the hooks 12, 12 and the brackets 14*a*, 14*b* respectively.

In the negative dobby machine as above constituted, when the shedding lever (not shown) of the negative dobby machine body 2 oscillates and the ropes 3*a*, 3*b* are pulled, the left working lever 4*a* rotates in the clockwise direction against torque of the coil spring 13 and the right working lever 4*b* rotates in the counterclockwise direction, thereby the heald frame 11 is moved downwards through the connecting rods 8, 8. When the shedding lever is restored, both working levers 4*a*, 4*b* are also restored by means of the restoring force of the coil spring 13, thereby the heald frame is moved upwards. Since the longitudinal position on the upper side of the heald frame 11 is defined by the connecting rods 8, the heald frame 11 is provided with a guide member (not shown) only at the lower side thereof. In order to refine clothing fashion in spun yarn fabric, the distance from the shedding neutral position (i.e. the position where the warp is displaced neither upwards nor downwards by means of the heald) to the downward warp position is set larger than that to the upward warp position. Accordingly, tension in the downward warp is larger than that in the upward warp tension coil spring 13 with less tension may be used. As a result, the force applied to the rope or the negative dobby machine body 2 in order to drive the heald frame 11 against the spring tension becomes small.

Although the above mentioned embodiment is described regarding a negative dobby machine, similar function is obtained when the negative dobby machine body 2 is replaced by a negative cam machine body in the above mentioned embodiment.

Moreover, the tension coil spring 13 in the above mentioned embodiment may be replaced by another tension coil spring connecting the heald frame 11 with the top beam 1.

What is claimed is:

1. A heald frame driving means in a loom having a negative shedding device and resilient transmission members connected to a shedding lever of said negative shedding device disposed above the heald frame which is driven thereby, said driving device comprising:

a pair of working levers pivotally supported on the upper portions of lateral frame members of said loom, said working levers having a sector surface formed on the upper side thereof and means for fixing said resilient transmission members respectively thereto;

a connecting rod pivotally supported at one end of each of said working levers and connected to the heald frame; and a tension spring connected between the other end of each of said working levers and said frame members;

said driving means being so arranged that said heald frame is lowered when said transmission members are pulled by said shedding levers, and said heald frame is elevated by the restoring force of said tension springs when said shedding lever is restored.

2. An apparatus for returning a heald frame controlled by a negative shedding device in a loom, comprising:

a loom frame top member and a pair of loom frame side members;

a heald frame disposed within said loom frame members;

a pair of working levers pivoted, respectively, on said loom frame side members, said working levers being formed with sector shaped upper surfaces, and with arms extending above said heald frame;

connecting rods connected to said heald frame and extending upwardly to said arms and connected thereto;

resilient transmission members connected between said shedding device and said sector shaped surfaces to urge said heald frame downwardly; and a pair of tension spring members connected to apply upward restoring force to said heald frame.

* * * * *